US010260496B2

(12) United States Patent
Beenker

(10) Patent No.: US 10,260,496 B2
(45) **Date of Patent: *Apr. 16, 2019**

(54) DELIVERY DEVICE

(71) Applicant: Qonqave GmbH, Wernau (DE)

(72) Inventor: Jan W. Beenker, Stuttgart (DE)

(73) Assignee: Qonqave GmbH, Wernau (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/536,761

(22) PCT Filed: Dec. 17, 2015

(86) PCT No.: PCT/EP2015/080236
§ 371 (c)(1),
(2) Date: Jun. 16, 2017

(87) PCT Pub. No.: WO2016/097153
PCT Pub. Date: Jun. 23, 2016

(65) Prior Publication Data

US 2017/0350385 A1 Dec. 7, 2017

(30) Foreign Application Priority Data

Dec. 17, 2014 (DE) ..... 10 2014 118 924

(51) Int. Cl.
*F04B 43/14* (2006.01)
*F04B 43/02* (2006.01)
(Continued)

(52) U.S. Cl.
CPC ..... *F04B 43/14* (2013.01); *F04B 43/02* (2013.01); *F04B 43/021* (2013.01);
(Continued)

(58) Field of Classification Search
CPC ..... F04B 43/14; F04B 43/02; F04B 43/021; F04B 43/1238; F04B 43/025
(Continued)

(56) References Cited

U.S. PATENT DOCUMENTS 2,015,123 A * 9/1935 Pennell ..... F04B 43/12 417/477.4
4,558,991 A * 12/1985 Barr ..... F04C 2/1076 417/199.1
(Continued)

FOREIGN PATENT DOCUMENTS

CA 2 422 579 C 3/2003
DE 3542454 A1 6/1987
(Continued)

OTHER PUBLICATIONS

Pamplona et al. "Finite deformations of cylindrical membrane under internal pressure", 2006, pp. 683-696.*
(Continued)

*Primary Examiner* — Charles Freay
*Assistant Examiner* — Lilya Pekarskaya
(74) *Attorney, Agent, or Firm* — Posz Law Group, PLC

(57) ABSTRACT

A conveying device at least for conveying a conveying medium includes at least one conveying space, with at least one conveying space element, which at least partly delimits the conveying space and is embodied in a rigid fashion, and with at least one elastically deformable conveying element which delimits the conveying space together with the conveying space element. The conveying space element includes at least one concave recess for at least partly forming the conveying space, wherein an inner surface of the conveying space element, which delimits the concave recess, forms a wall of the conveying space, wherein the conveying element comprises at least one conveying surface, which is utilizable in targeted fashion for a conveyance of a fluid in the conveying space and/or through the conveying space.

10 Claims, 3 Drawing Sheets

Figure 1:
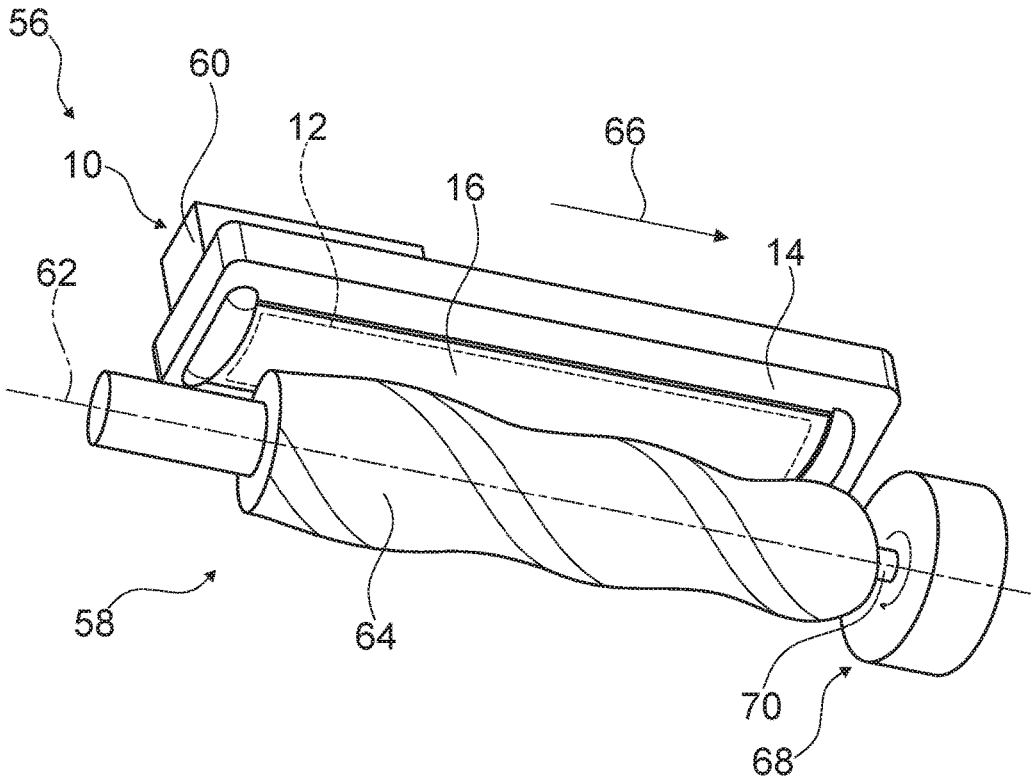

(51) Int. Cl.
*F04B 43/04* (2006.01)
*F04B 43/12* (2006.01)

(52) U.S. Cl.
CPC ..... *F04B 43/023* (2013.01); *F04B 43/028* (2013.01); *F04B 43/04* (2013.01); *F04B 43/123* (2013.01); *F04B 43/1207* (2013.01)

(58) Field of Classification Search
USPC ..... 417/477.4, 475
See application file for complete search history.

(56) References Cited

U.S. PATENT DOCUMENTS 5,533,886 A 7/1996 Von Der Heyde et al.
5,575,632 A * 11/1996 Morris ..... A61M 5/14228 128/DIG. 12
5,620,313 A * 4/1997 Fockenberg ..... F04B 43/12 417/475
6,235,381 B1 * 5/2001 Sanders ..... B21K 5/20 156/296
7,217,108 B2 * 5/2007 Herwig ..... F04B 43/082 417/474
7,918,657 B2 * 4/2011 Bobo ..... F04B 43/1253 384/548
2003/0175138 A1 * 9/2003 Beenker ..... F04B 43/02 417/474
2012/0177506 A1 * 7/2012 Orter ..... A61M 1/1053 417/53

FOREIGN PATENT DOCUMENTS

DE 10 2009 037845 A1 4/2011
EP 1 317 626 B1 6/2003
JP 6235381 B2 11/2017
WO 096/08704 A1 3/1996

OTHER PUBLICATIONS

Search Report dated Oct. 15, 2015 issued in corresponding DE patent application No. 10 2014 118 924.8 (and partial English translation).
International Search Report of the International Searching Authority dated Mar. 29, 2016 issued in corresponding International Patent Application No. PCT/EP2015/080236.
International Preliminary Report on Patentability dated Jun. 22, 2017 issued in corresponding International Patent Application No. PCT/EP2015/080236 (and German version dated Dec. 2, 2016 with Article 34 amendments).
Japanese Office Action dated Dec. 5, 2017 in the corresponding JP application No. 2017-540797(English translation attached).
Office action dated Oct. 18, 2018 issued in corresponding Canadian patent application No. 2,971,251.

* cited by examiner

DELIVERY DEVICE

CROSS REFERENCE TO RELATED APPLICATIONS

This application is a U.S. national stage application of PCT/EP2015/080236 filed on Dec. 17, 2015, which claims priority to German Patent Application No. DE 10 2014 118 924.8 filed on Dec. 17, 2014, the contents of which are incorporated herein by reference.

PRIOR ART

The invention relates to a conveying device as per the preamble of claim 1.

EP 1 317 626 B1 and DE 35 42 454 A1 as well as DE 10 2009 037 845 A1 have already disclosed conveying devices for conveying a conveying medium. Here, the conveying devices comprise a conveying space, a conveying space element, which delimits the conveying space and is embodied in a rigid fashion, and an elastically deformable conveying element, which delimits the conveying space together with the conveying space element.

Furthermore, from U.S. Pat. No. 5,533,886 B a conveying device at least for conveying a conveying medium is already known, comprising at least one conveying space, at least one conveying space element, which at least partly delimits the conveying space and is embodied in a rigid fashion, and with at least one elastically deformable conveying element, which delimits the conveying space together with the conveying space element, wherein the conveying space element comprises at least one concave recess for at least partly forming the conveying space, wherein an inner surface of the conveying space element, which delimits the concave recess, forms a wall of the conveying space, wherein the conveying element comprises at least one conveying surface, which is utilizable in targeted fashion for a conveyance of a fluid in the conveying space and/or through the conveying space.

It is the object of the invention in particular to provide a generic device which has improved characteristics with regard to a low load on the conveying element due to a deformation, for the purpose of reducing a compression, respectively expansion, of the conveying element during a conveyance of a fluid. The object is achieved according to the invention by means of the features of patent claim 1, whereas advantageous embodiments and refinements of the invention emerge from the subclaims.

ADVANTAGES OF THE INVENTION

The invention is based on a conveying device at least for conveying a conveying medium, with at least one conveying space, with at least one conveying space element, which at least partly delimits the conveying space and is embodied in a rigid fashion, and with at least one elastically deformable conveying element, which delimits, in particular forms, the conveying space together with the conveying space element, wherein the conveying space element comprises at least one concave recess for at least partly forming the conveying space, wherein an inner surface of the conveying space element, which delimits the concave recess, forms a wall of the conveying space, wherein the conveying element comprises at least one conveying surface, which is utilizable for a conveyance of a fluid in the conveying space and/or through the conveying space.

It is proposed that, in a load-free state of the conveying element, the at least one conveying surface, viewed in a cross-section of the conveying element, has a maximum transverse extent which is equivalent to a maximum transverse extent of the rigid wall of the conveying space element, which wall at least partly delimits at least the conveying space, wherein at least the conveying element is embodied in a spring-elastic fashion, wherein, following a deformation, the conveying element automatically seeks to re-assume a convexly curved basic shape of the conveying element. It is particularly preferable if the conveying element comprises the at least one conveying surface which, viewed in a cross-section of the conveying element, has a maximum transverse extent which is entirely equivalent to or congruent with, the maximum transverse extent of the rigid wall of the conveying space element, which wall at least partly delimits at least the conveying space. It may also conceivably be provided that, in a loaded state of the conveying element, the maximum transverse extent of the conveying surface of the conveying element is equivalent to the maximum transverse extent of the rigid wall of the conveying space element, which wall at least partly delimits at least the conveying space.

The conveying device is preferably provided for use in the medical sector. It is however also conceivable for the conveying device to be provided for use in other sectors, for example in a foodstuffs sector, in a chemistry sector, in a pharmaceutical sector, in particular for batch-compliant use, in a vivarium sector (aquarium etc.), in a household appliance sector, in a dental hygiene sector or the like. The expression "provided" is to be understood in particular to mean specially designed and/or specially equipped. The statement that an element and/or a unit are/is provided for a particular function is to be understood in particular to mean that the element and/or the unit perform(s) and/or carry/carries out said particular function in at least one usage and/or operating state. The expression "at least substantially" is to be understood, in particular at least in conjunction with extents and/or dimensioning, to mean that a deviation deviates from a predefined value by in particular less than 25%, preferably less than 10%, particularly preferably less than 5% of the predefined value, and very particularly preferably corresponds entirely to the value.

Here, the expression "conveying space" defines in particular a space which is delimited at least by the elastically deformable conveying element and by the conveying space element embodied in a rigid fashion and which extends in particular between the conveying element and the conveying space element at least from an inlet of the space, through which a conveying medium for conveying can be introduced into the space, to at least one outlet of the space, through which a conveying medium for conveying can be discharged from the space. It is preferable for the conveying space to extend between the conveying element and the conveying space element at least from a conveying space inlet of the conveying space to a conveying space outlet of the conveying space.

Here, the expression "embodied in a rigid fashion" is intended in particular to define an embodiment of an element in which the element is of at least substantially stiff, immovable and/or inelastic form. The conveying space element is thus preferably provided so as to remain at least substantially, in particular entirely, unchanged in terms of shape for a conveyance of a conveying medium.

The conveying element is preferably provided so as to be deformed, in particular elastically deformed, for a conveyance of a conveying medium, in particular a fluid. The conveying element is preferably provided so as to permit a conveyance of a conveying medium out of and/or through the conveying space as a result of a deformation, in particular a repeatable elastic deformation, of the conveying element. The conveying element is preferably deformable, in particular repeatedly elastically deformable, such that, for a conveyance of a conveying medium, the conveying element is movable in the direction of the recess, which is formed correspondingly to the conveying element, of the conveying device, in particular the concave recess of the conveying space element, and is in particular movable at least partly into said recess. It is thus advantageously possible to realize dynamic conveyance of a conveying medium or conveyance of a conveying medium with displacement action. For conveyance of a conveying medium with displacement action, the conveying element can preferably be caused, as a result of a deformation, to at least partly bear directly, in particular in form-fitting fashion, against an inner surface, which delimits the recess and in particular encompasses the recess, of the conveying device, in particular of the conveying space element of the conveying device. The conveying element is preferably in the form of a diaphragm pump element, in particular a flexurally rigid and/or spring-elastic diaphragm pump element. The conveying element is preferably formed so as to differ from a peristaltic pump element, in particular an expansion-flexible hose of a peristaltic pump device.

The elastically deformable conveying element is preferably provided for sealing off at least one edge region, which delimits the conveying space, of the conveying space element embodied in a rigid fashion, in particular in at least a state in which the conveying element is arranged on the conveying space element. The elastically deformable conveying element can preferably be arranged on the conveying space element embodied in a rigid fashion such that the at least one edge region, which delimits the conveying space, of the conveying space element can be sealed off. Sealing-off of the at least one edge region, which delimits the conveying space, of the conveying space element may be realized directly by means of the conveying element. It is however alternatively or additionally also conceivable for a seal element of the conveying device to be provided which can be arranged between the conveying element and the conveying space element, in particular on the at least one edge region, which delimits the conveying space, of the conveying space element. The seal element of the conveying device may be formed as a rubber seal, as a sealing cord, as a sealing lip, as a flexible seal compound, as a fiber seal, as a paper seal or the like.

It is preferable for the maximum transverse extent of the conveying surface to run at least substantially transversely, in particular at least substantially perpendicularly, to a conveying direction in the conveying space. The conveying direction in the conveying space preferably runs from the conveying space inlet to the conveying space outlet. Here, the expression "at least substantially transversely" is to be understood in particular to mean an orientation of a direction and/or of an axis relative to a reference direction and/or a reference axis, wherein the orientation of the direction and/or of the axis is at least different from an at least substantially parallel orientation with respect to the reference direction and/or with respect to the reference axis and is in particular skewed or perpendicular with respect to the reference direction and/or with respect to the reference axis. Here, the expression "at least substantially perpendicularly" is intended in particular to define an orientation of a direction relative to a reference direction, wherein the direction and the reference direction, viewed in particular in one plane, enclose an angle of 90° and the angle has a maximum deviation of in particular less than 8°, advantageously less than 5° and particularly advantageously less than 2°.

It is preferable for at least the conveying space element embodied in a rigid fashion and the elastically deformable conveying element to together form an exchangeable unit. Here, an "exchangeable unit" is to be understood in particular to mean a unit which is removable as a whole, in particular without being destroyed or without disassembly of individual parts, from an element or from a further unit, such as for example from a housing unit or the like, in particular after a release of at least one fastening element which is provided for fastening the unit on the element or on the further unit. In particular, the exchangeable unit is at least substantially free from function, and/or non-functional, when in a removed state, in particular in a state removed from a housing unit of a pump device which at least partly comprises the conveying device. The conveying device is preferably provided for being arranged on the pump device. The exchangeable unit is preferably removable as a whole from the pump device, in particular from the housing unit of the pump device, without being disassembled into individual parts. It is preferable for at least the conveying space element and the conveying element to be removable jointly from the pump device, in particular from the housing unit of the pump device. It is preferable if the exchangeable unit is, after being removed from the pump device, in particular from the housing unit of the pump device, exchangeable for a replacement or substitute unit which, with regard to at least one function of the replacement or substitute unit, at least substantially corresponds to at least one function of the exchangeable unit. The exchangeable unit is preferably designed such that, in the event of an exchange of the exchangeable unit, a loss of fluid and/or an escape of fluid from the conveying device and/or from the pump device are/is at least substantially preventable. The exchangeable unit is preferably formed as a disposable article unit. It is however also conceivable for the exchangeable unit to be in the form of an interchangeable unit, a wearing part unit, a substitute unit or the like.

The conveying device preferably comprises at least one conveying medium store unit for storing a conveying medium, in particular a fluid. Here, a "conveying medium store unit" is to be understood in particular to mean a unit which has at least one storage space in which a conveying medium, in particular a fluid, can be stored. It is preferable for a volume of the storage space of the conveying medium store unit to be at least larger than a volume of the conveying space. The conveying medium store unit is preferably formed in the manner of a tank. Here, the conveying medium store unit may be in the form of a carpule, an ampule, a cartridge or the like. The conveying medium store unit is preferably connected in terms of flow to the conveying space. It is preferable for an outlet of the conveying medium store unit to be connected, in particular connected in fluid-tight fashion, by means of at least one duct of the conveying device to the conveying space inlet of the conveying space. A conveying medium stored in the storage space of the conveying medium store unit can thus advantageously be conveyed out of the storage space by means of an interaction of the conveying element and the conveying space element.

The expression "spring-elastic" is to be understood in particular to mean a characteristic of an element, in particular of the conveying element, which characteristic is provided in particular for generating an opposing force which is dependent on a change in a shape of the element and which is preferably proportional to the change and which counteracts the change. The conveying element is preferably repeatedly deformable without the conveying element thereby being mechanically damaged or destroyed. The spring-elastic form of the conveying element can preferably be at least partly influenced and/or realized by means of the convex arrangement on the conveying space element. The conveying element is preferably arranged on the conveying space element such that a conveying medium is conveyed in and/or through the conveying space as a result of an inward bulging of the conveying element. After an elimination of an action of a drive force on the conveying element for a conveyance of a conveying medium, the conveying element automatically seeks to re-assume the convexly curved arrangement on the conveying space element again preferably at least substantially, in particular owing to the spring-elastic form. The conveying element is preferably produced from a spring steel or from a fiber composite material. It is however also conceivable for the conveying element to be produced from some other material which appears expedient to a person skilled in the art and which permits a spring-elastic form of the conveying element. The conveying element preferably utilizes a "bulging effect" for a conveyance of a conveying medium in and/or through the conveying space. The conveying element can preferably be at least temporarily inwardly bulged for a conveyance of a conveying medium, wherein at least one bulge is displaceable, in particular displaceable in rolling fashion, along a longitudinal axis of the conveying element for the purposes of conveying a conveying medium. The conveying element is preferably of dimensionally stable form. Here, "dimensionally stable" is to be understood to mean that the conveying element is preferably formed so as to be resilient in terms of shape with respect to pressure, heat or the like.

By means of the embodiment according to the invention, it is advantageously possible to achieve at least substantially loss-free conveyance of a conveying medium in and/or through the conveying space. Furthermore, it is advantageously possible to achieve a long service life of the conveying device. Furthermore, by means of the embodiment according to the invention, it is advantageously possible to permit efficient conveyance of a conveying medium. It is furthermore advantageously possible for an internal stress, in particular an internal mechanical stress, of the conveying element to be utilized for a conveyance of a conveying medium.

It is furthermore proposed that, in a load-free state, the conveying element, in particular the conveying surface of the conveying element, comprises, viewed in a cross-section of the conveying element, at least one circular arc segment, in particular a single circular arc segment, which has a maximum length composed of a sum of maximum lengths of circular arc segments, in particular of all circular arc segments which delimit the conveying space, of the rigid wall of the conveying space element. Here, a "load-free state" is to be understood in particular to mean a state of the conveying element in which the conveying element is free from drive forces for a conveyance of a conveying medium, in particular free from drive forces, which act on the conveying element, of a drive element of a drive unit of the pump device. The circular arc segment of the conveying element is preferably a part of the conveying surface, in particular of the maximum transverse extent of the conveying surface. The rigid wall of the conveying space element advantageously comprises, viewed in a cross-section, an undulating design, wherein, in particular, an undulation trough is arranged between two undulation peaks, which undulation trough forms in particular the concave recess of the conveying space element. The cross-section particularly preferably runs in a plane running at least substantially perpendicular to the conveying direction. The circular arc segments of the rigid wall of the conveying space element preferably run in the plane running at least substantially perpendicular to the conveying direction. It is however also conceivable for the conveying element, viewed along a longitudinal section, to alternatively or additionally comprise a circular arc segment, in particular a single circular arc segment, which has a maximum length composed of a sum of maximum lengths of circular arc segments of the rigid wall of the conveying space element, which maximum length is in particular equivalent to said sum. The inner surface, which delimits the rigid wall of the conveying space element, is preferably delimited by the circular arc segments. It is preferable if at least a major part, in particular more than 80%, of the conveying element, in particular the conveying surface, in a state arranged on the conveying space element and free from load, forms the circular arc segment, which, viewed in a cross-section of the conveying element, has a maximum length composed of a sum of maximum lengths of circular arc segments, in particular of all circular arc segments which delimit the conveying space, of the rigid wall of the conveying space element. It is preferable if a part of the conveying element which does not form a circular arc segment and which bears against the conveying space element permanently, in particular in a state in which the conveying element is arranged on the conveying space element, is configured for fixing the conveying element to the conveying space element and/or for sealing off the conveying space. By means of the embodiment according to the invention, it is advantageously possible to realize the possibility of form-fitting abutment of the conveying element against the conveying space element. Furthermore, complete abutment of the conveying surface against the conveying space element for a conveyance of a conveying medium can advantageously be achieved. It is advantageously possible to achieve at least substantially loss-free conveyance of a conveying medium, because it is possible to achieve that the conveying space is sealed off over a full area during a conveying movement of the conveying element.

It is furthermore proposed that the rigid wall of the conveying space element comprises, viewed in a cross-section, in particular in the cross-section which runs in the plane extending at least substantially perpendicular to the conveying direction, at least three consecutive circular arc segments The three consecutive circular arc segments of the rigid wall of the conveying space element are preferably part of the inner surface, which delimits the conveying space, of the conveying space element. The three consecutive circular arc segments of the rigid wall of the conveying space element come into contact, during a conveyance of a conveying medium, with a conveying medium to be conveyed. It is preferable if, as viewed along a direction running at least substantially perpendicular to the conveying direction, the three consecutive circular arc segments of the rigid wall of the conveying space element are arranged in alternating fashion with regard to a curvature characteristic. It is preferable for two of the three consecutive circular arc segments of the rigid wall of the conveying space element to have a convex curvature, and one of the three consecutive circular arc segments of the rigid wall of the conveying space element preferably has a concave curvature. It is preferable if, viewed along the direction running at least substantially perpendicular to the conveying direction, the concavely curved circular arc segment of the rigid wall of the conveying space element is arranged between the two convexly curved circular arc segments of the rigid wall of the conveying space element. By means of the embodiment according to the invention, it is possible in a simple manner in terms of design to achieve an embodiment of the rigid wall of the conveying space element corresponding to an embodiment of the conveying element during a deformation of the conveying element for a conveyance of a conveying medium. It can advantageously be ensured that the conveying element can be caused to bear against the conveying space element in form-fitting fashion, in particular over a full area, for a conveyance of a conveying medium.

It is furthermore proposed that the rigid wall of the conveying space element comprises, viewed in a cross-section, in particular in the cross-section which runs in the plane extending at least substantially perpendicular to the conveying direction, at least three circular arc segments, wherein at least two of the three circular arc segments of the rigid wall of the conveying space element have different radii. It is preferable for two of the three circular arc segments of the rigid wall of the conveying space element to have equal radii. It is however also conceivable for the three circular arc segments of the rigid wall of the conveying space element to have equal radii, or for all three circular arc segments of the rigid wall of the conveying space element to have different radii. It is furthermore conceivable for the rigid wall of the conveying space element to have a number other than three of circular arc segments which have different or equal radii. That circular arc segment of the rigid wall of the conveying space element which is arranged between said two of the circular arc segments of the rigid wall of the conveying space element preferably has a radius which differs from the radii of those two circular arc segments of the rigid wall of the conveying space element which between them delimit the circular arc segment of the rigid wall of the conveying space element. By means of the embodiment according to the invention, it is advantageously possible to realize a smooth transition of a conveying movement of the conveying element in the event of a form-fitting abutment of the conveying element against the conveying space element. It is advantageously possible to realize a low load on the conveying element as a result of a deformation, in particular an elastic deformation, of the conveying element for a conveyance of a conveying medium.

It is furthermore proposed that the rigid wall of the conveying space element comprises, viewed in a cross-section, in particular in the cross-section which runs in the plane extending at least substantially perpendicular to the conveying direction, at least two directly consecutive circular arc segments, which are arranged in such a way that they abut on each other in an inflection point, wherein, in particular, each of the circular arc segments of the rigid wall of the conveying space element has at least one mathematical change in gradient or a change in curvature characteristic. It is preferable for one of the circular arc segments of the rigid wall of the conveying space element to have a concave curvature and for one of the circular arc segments of the rigid wall of the conveying space element to have a convex curvature, wherein the circular arc segments of the rigid wall of the conveying space element are arranged in such a way that they abut on each other in an inflection point. By means of the embodiment according to the invention, it is possible to realize a particularly advantageous conveying geometry.

It is furthermore proposed that, at least in a load-free state, the conveying element comprises at least one circular arc segment having a radius which is greater than a radius of at least one circular arc segment of the rigid wall of the conveying space element. The conveying element preferably comprises, at least in a load-free state, at least one circular arc segment having a radius which is greater than all radii of circular arc segments of the rigid wall of the conveying space element. By means of the embodiment according to the invention, it is advantageously possible to realize a large conveying surface of the conveying element, which can particularly advantageously be caused to bear against the rigid wall of the conveying space element for a conveyance of a conveying medium.

It is furthermore proposed that the conveying device has a maximum conveying space height between the conveying element and the conveying space element, which is smaller than a radius of at least one circular arc segment of the rigid wall of the conveying space element and/or than a radius of at least one circular arc segment of the conveying element. The conveying space height preferably runs along a direction running at least substantially perpendicular to the conveying direction. By means of the embodiment according to the invention, it is advantageously possible to realize a conveying device which is of particularly flat construction and which can permit a high level of conveying performance.

It is also proposed that the conveying element is arrangeable on the conveying space element in an at least partly convexly curved fashion. The conveying element is preferably, in a state of non-conveyance, arranged in convexly curved fashion on the conveying space element. For a conveyance of a conveying medium, the conveying element is preferably movable, in particular elastically deformable, in the direction of the conveying space element proceeding from a convex curvature oriented in a direction pointing away from the conveying space element, and is in particular movable at least partly into the concave recess of the conveying space element. For a conveyance of a conveying medium, the conveying element can preferably be changed at least partly from a convex curvature into a concave curvature. The conveying element can preferably be caused to bear at least partly against the inner surface, which delimits the concave recess of the conveying space element and which is oriented in particular in the direction of the conveying element, of the conveying space element, in particular owing to a drive force acting on the conveying element. It is very particularly preferably possible for at least one conveying surface of the conveying element to be caused to bear entirely against the inner surface of the conveying space element, which inner surface delimits the concave recess of the conveying space element, as a result of an elastic deformation of the conveying element, in particular as a result of a drive force acting on the conveying element.

The conveying element is advantageously connected at least substantially non-detachably to the conveying space element. The conveying element may be connected along an entire circumference, in particular as viewed in at least one plane, in at least substantially non-detachable fashion to the conveying space element, or the conveying element may be connected by means of at least one single side in at least substantially non-detachable fashion to the conveying space element, for example by means of a film hinge or the like. The conveying element and the conveying space element are preferably formed in one piece, for example by means of an injection molding process or the like, in particular with an at least substantially non-detachable connection of the conveying element and of the conveying space element by means of a film hinge or the like. The conveying element and the conveying space element are preferably formed from an identical material, for example plastic or metal, or from an identical material composite, for example GRP, some other composite material or the like. It is however also conceivable for the conveying element and the conveying space element to be formed from different materials and to be connected to one another in at least substantially non-detachable fashion.

Furthermore, a pump device with at least one conveying device according to the invention and with at least one drive unit for driving the conveying device is proposed. The conveying element can preferably be driven by means of the drive unit such that a conveyance of a conveying medium in accordance with a traveling-wave principle can be made possible. The drive unit may be in the form of a mechanical drive unit, a magnetic drive unit, a piezoelectric drive unit, a hydraulic drive unit, a pneumatic drive unit, an electric drive unit, a magnetorheological drive unit, a carbon tubes drive unit, a combination of one of the said types of drive units, or some other drive unit that appears expedient to a person skilled in the art. The drive unit preferably comprises at least one drive element which is provided so as to act on the conveying element, in particular is provided so as to effect an elastic deformation of the conveying element as a result of an action of a drive force on the conveying element. The drive element may be designed in any form that appears expedient to a person skilled in the art, and may for example be designed as a plunger, as a projection, as a helix, as a cam, as a piezo element, as a magnet, as an eccentric or the like. The drive unit preferably comprises at least one electric motor unit which is in particular configured to drive at least the drive element. It is however also conceivable for the drive unit to comprise some other motor unit that appears expedient to a person skilled in the art, for example a combustion engine unit, a hybrid motor unit or the like. It is alternatively also conceivable for the pump device to be operable manually, in particular by hand. In an embodiment of the pump device as a manual operable pump device, a fluid can be at least transported into the conveying space as a result of the action of a force exerted on the conveying element by a hand, in particular by at least one finger, of an operator, and/or can be at least transported out of the conveying space as a result of the action of a force exerted on the conveying element by a hand, in particular by at least one finger, of an operator. The manual operable pump device preferably comprises at least one valve unit, which has for example at least one valve, in particular a one-way valve (for example check valve or the like), at a conveying space inlet and at least one valve, in particular a one-way valve (for example check valve or the like), at a conveying space outlet. The pump device preferably comprises at least one housing unit on which the conveying device can be arranged, in particular can be arranged in exchangeable fashion.

The drive unit is preferably embodied as a helical drive unit or as an eccentric drive unit. Here, a "helical drive unit" is to be understood in particular to mean a drive unit which has at least one helical drive element which is provided in particular for subjecting the conveying element to the action of a drive force, in particular to the direct action of a drive force. It is however also conceivable for the drive unit to be of some other design that appears expedient to a person skilled in the art, for example designed as a paternoster drive unit, as a plate disk drive unit or the like. Here, a "paternoster drive unit" is to be understood in particular to mean a drive unit which has at least one force action element which, in particular for an action of a drive force, in particular a direct action of a drive force, on the conveying element, can be driven in rotation, wherein it is provided in particular that the force action element, for an action of a drive force on the conveying element, extends at least substantially parallel to a plane of rotation, in particular in the plane of rotation, in which the force action element can be driven in rotation. Here, a "plate disk drive unit" is to be understood in particular to mean a drive unit which has at least one drive element which, in particular for an action of a drive force, in particular a direct action of a drive force, on the conveying element, is arranged on a plate element which can be driven in rotation, wherein it is provided in particular that the drive element, for an action of a drive force on the conveying element, extends at least substantially parallel to an axis of rotation of the plate element.

The drive unit preferably comprises at least one drive element embodied as a helix or at least one drive element embodied as an eccentric. The drive element is preferably provided for acting directly on the conveying element. It is however also conceivable for at least one further element or further elements to be arranged between the drive element and the conveying element, such as for example a friction-reducing element, a support element or the like. In an embodiment as a drive helix, the drive element may have one or more helix elements which has/have for example a circular-segment-like cross-section, or an undulating cross-section, in particular an undulating cross-section with at least two undulation peaks and one undulation trough, wherein the undulation peaks may have identical or different maximum heights. The one or more helix element(s) may be formed from a resiliently elastic material or may be formed from the same material as a main body of the drive element. Further embodiments of the drive element that appear expedient to a person skilled in the art are likewise conceivable. It is advantageous for at least one drive axis of the drive unit to extend at least substantially parallel to the conveying direction of the conveying device, in particular with respect to a conveying direction in the conveying space. In the case of an embodiment of the drive unit as a helical drive unit or as an eccentric drive unit, it is preferably the case that an axis of rotation of the drive element embodied as a helix or of the drive element embodied as an eccentric, which axis of rotation forms the drive axis of the drive unit, runs at least substantially parallel to the conveying direction in the conveying space. It is preferable for an axis of rotation of a rotor element of the electric motor unit of the drive unit to run at least substantially parallel to the conveying direction in the conveying space. The axis of rotation of the rotor element of the electric motor unit preferably forms a further drive axis, which runs at least substantially parallel to the conveying direction in the conveying space. By means of the embodiment according to the invention, it is advantageously possible to realize a pump device which permits a design of very flat construction. It is thus advantageously possible to realize a compact design of the pump device.

Here, it is not the intention for the conveying device according to the invention and/or the pump device according to the invention to be restricted to the usage and embodiment described above. In particular, in order to perform a function described herein, the conveying device according to the invention and/or the pump device according to the invention may have a number of individual elements, components and units and method steps which differs from a number mentioned herein. Furthermore, with regard to the value ranges specified in this disclosure, it is also intended that values lying within the stated limits are disclosed and usable as desired.

DRAWINGS

Further advantages emerge from the following description of the drawings. The drawings illustrate an exemplary embodiment of the invention. The drawings, the description and the claims contain numerous features in combination. A person skilled in the art will expediently also consider the features individually and combine these to form further meaningful combinations.

Figure 2:
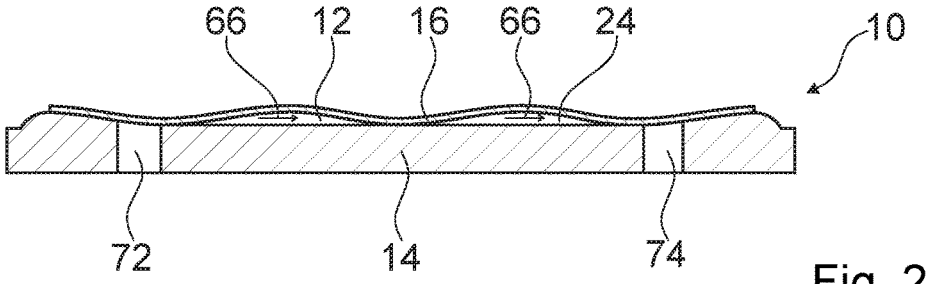
Figure 3:
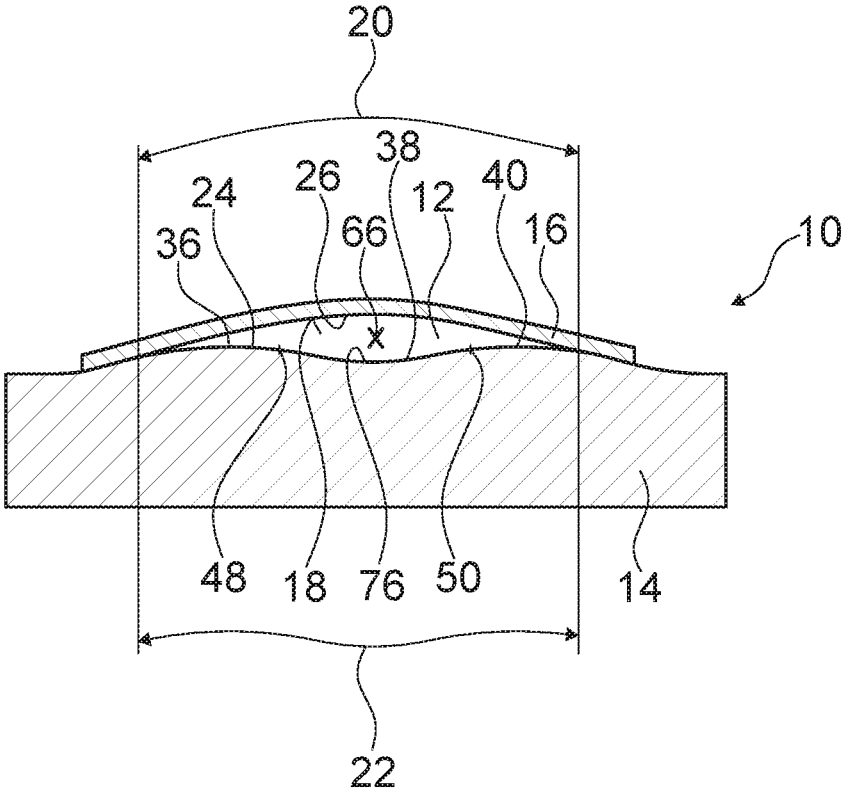
Figure 4:
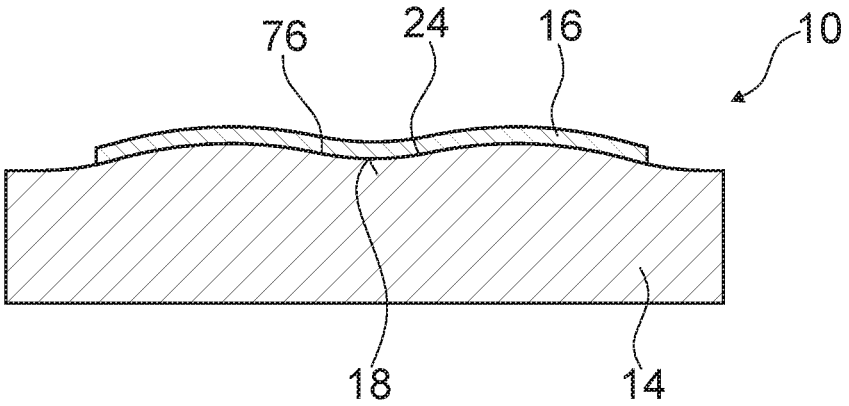
Figure 5:
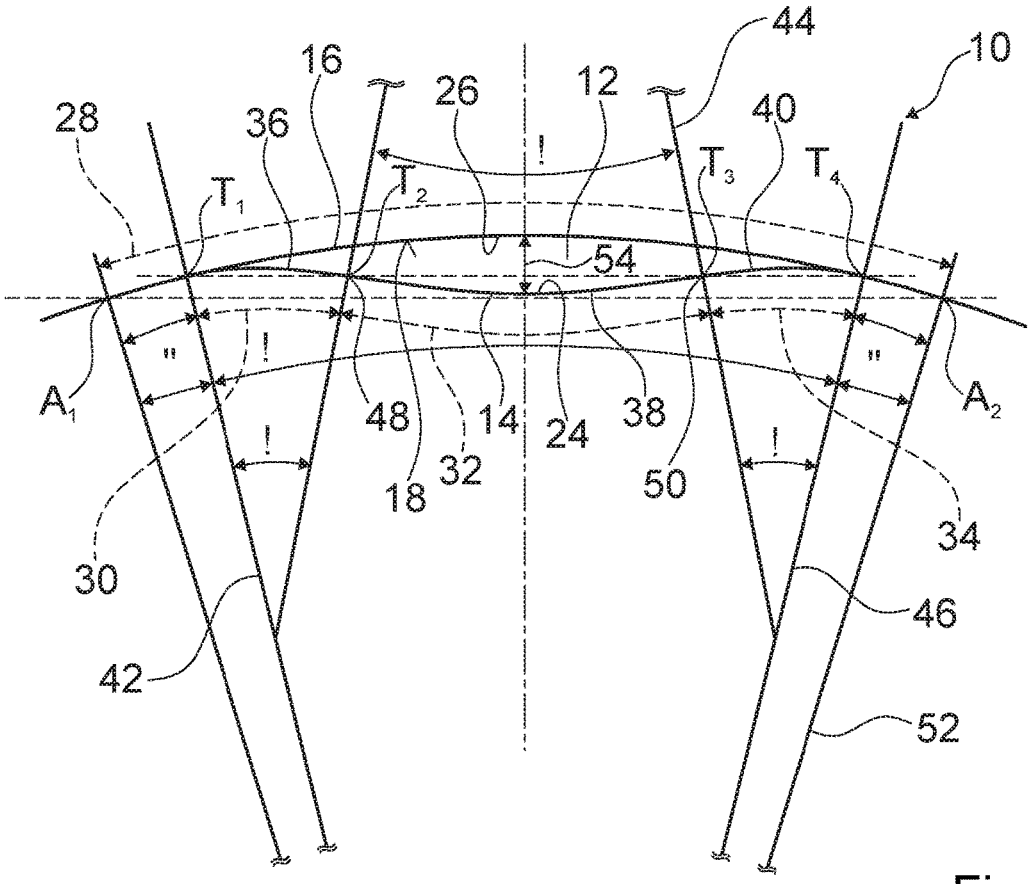

In the drawings:

FIG. 1 shows a pump device according to the invention with at least one conveying device according to the invention in a schematic illustration, FIG. 2 shows a longitudinal section through a conveying space of the conveying device according to the invention, which conveying space is formed by a conveying element and by a conveying space element of the conveying device according to the invention, in a schematic illustration, FIG. 3 shows a cross-section through a conveying space of the conveying device according to the invention in a load-free state of a conveying element of the conveying device according to the invention in a schematic illustration, FIG. 4 shows a cross-section through a conveying space of the conveying device according to the invention in a loaded state of a conveying element of the conveying device according to the invention in a schematic illustration, and FIG. 5 shows a detail view of a geometrical design of the conveying element of the conveying device according to the invention and of a conveying space element of the conveying device according to the invention in a schematic illustration.

DESCRIPTION OF THE EXEMPLARY EMBODIMENT

FIG. 1 shows a pump device 56 with at least one conveying device 10 and with at least one drive unit 58 for driving the conveying device 10. For control and/or regulation of the drive unit 58, the pump device 56 comprises at least one control and/or regulation unit (neither of which is illustrated here), which is of a design already known to a person skilled in the art. The drive unit 58 is embodied as a helical drive unit or as an eccentric drive unit. At least one drive axis 62 of a drive element 64 of the drive unit 58 runs at least substantially parallel to a conveying direction 66 of the conveying device 10, in particular at least substantially parallel to a conveying direction 66 through at least one conveying space 12 of the conveying device 10. The drive element 64 is in the form of a drive helix or an eccentric shaft. The drive element 64 is rotatably supported in a housing unit (not illustrated in any more detail here) of the pump device 56 in a manner already known to a person skilled in the art. The drive axis 62 is configured as an axis of rotation of the drive element 64. The drive element 64 is provided for elastically deforming at least one conveying element 16 of the conveying device 10, which conveying element is allocated at least to the conveying space 12, for a conveyance of a conveying medium. The conveying element 16 allocated at least to the conveying space 12 is embodied in an elastically, in particular spring-elastically, deformable fashion. The drive element 64 is provided for generating a traveling-wave movement of the conveying element 16, which is allocated at least to the conveying space 12, along a longitudinal axis of the conveying element 16 allocated at least to the conveying space 12. Here, it is conceivable for the drive element 64 to act directly on the conveying element 16 allocated at least to the conveying space 12, or for an exciter element (not illustrated in any more detail here) of the conveying device 10 to be arranged between the drive element 64 and the conveying element 16 allocated at least to the conveying space 12, which exciter element is acted on directly by the drive element 64, wherein the exciter element transmits an action of drive forces to the conveying element 16 allocated at least to the conveying space 12, which conveying element bears at least partly against the exciter element.

For a movement, in particular a rotation of the drive element 64, the drive unit 58 comprises at least one motor unit 68. The motor unit 68 is formed as an electric motor unit. It is however also conceivable for the motor unit 68 to be of some other design that appears expedient to a person skilled in the art, for example to be designed as a combustion engine unit, as a hybrid motor unit or the like. The drive element 64 may be connected directly, in particular rotationally conjointly, or indirectly, for example by means of a gearing unit of the conveying device 10 or by means of at least one toothed gear element of the conveying device 10, to a rotor shaft 70 of the motor unit 68. The rotor shaft 70 has an axis of rotation which runs at least substantially parallel, in particular coaxially, with respect to the drive axis 62 of the drive element 64.

Furthermore, the conveying device 10 comprises at least one conveying medium store unit 60 for storing a conveying medium, wherein the conveying medium store unit 60 forms the exchangeable unit together with the conveying space element 14 and the conveying element 16. The conveying medium store unit 60 is connected at least substantially non-detachably to the conveying space element 14. It is however also conceivable, in an alternative embodiment of the conveying device 10 which is not illustrated in any more detail here, for the conveying medium store unit 60 of the conveying device 10 to not be a constituent part of the exchangeable unit, and to be fluidically connectable, in particular detachably connectable, to the exchangeable unit, in particular at least to the conveying space 12, by means of a conveying line, such as for example a hose, a duct or the like, of the conveying device 10, and for the exchangeable unit to be removable from the housing unit separately from the conveying medium store unit 60.

The conveying device 10 is configured at least for conveying a conveying medium. The conveying device 10 comprises at least the conveying space 12, at least one conveying space element 14, which at least partly delimits the conveying space 12 and is embodied in a rigid fashion, and at least the elastically deformable conveying element 16, which delimits the conveying space 12 together with the conveying space element 14. At least the conveying space element 14 and the conveying element 16 together form an exchangeable unit. The exchangeable unit is detachably arrangeable on the housing unit. The conveying element 16 comprises at least one conveying surface 18 which, viewed in a cross-section of the conveying element 16, has a maximum transverse extent 20 which is at least substantially equivalent to a maximum transverse extent 22 of a rigid wall 24 of the conveying space element 14, which wall at least partly delimits at least the conveying space 12 (FIG. 3). It is particularly preferable if the conveying element 16 comprises at least one conveying surface 18 which, viewed in a cross-section of the conveying element 16, has a maximum transverse extent which is equivalent to, in particular entirely equivalent to or congruent with, a maximum transverse extent of the rigid wall 24 of the conveying space element 14, which wall at least partly delimits at least the conveying space 12.

FIG. 2 shows a longitudinal section through the conveying space 12 of the conveying device 10, which conveying space is formed at least by the conveying element 16 and by the conveying space element 14 of the conveying device 10. The conveying element 16 is of a polygonal, in particular rectangular, design. The conveying space element 14 is of a polygonal, in particular rectangular, design. The conveying medium store unit 60 is not illustrated in FIG. 2. The conveying element 16 is provided for sealing off at least one edge region, which delimits the conveying space 12, of the conveying space element 14. A conveying medium which can be conveyed in and/or through the conveying space 12 by means of an interaction of the conveying space element 14 and of the conveying element 16 can be introduced into the conveying space 12 via a conveying space inlet 72 of the conveying device 10. The conveying space inlet 72 is arranged on the conveying space element 14, and is in particular formed in one piece with the conveying space element 14. The conveying space inlet 72 is fluidically connected to the conveying medium store unit 60, and in particular is fluidically connected to a storage space outlet (not illustrated in any more detail here) of the conveying medium store unit 60. A conveying medium can be conveyed in and/or through the conveying space 12 by means of a reversible deformation of the conveying element 16. A conveying medium can be conveyed from the conveying space inlet 72 through the conveying space 12 to a conveying space outlet 74 of the conveying device 10 by means of a reversible deformation of the conveying element 16. The conveying space outlet 74 is arranged on the conveying space element 14, and is in particular formed in one piece with the conveying space element 14. The conveying space outlet 74 is fluidically connected to a further unit (not illustrated in any more detail here). The further unit may in this case be a part of the pump device 56, a part of an administration device on which the pump device 56 is arranged, a part of a household appliance on which the pump device 56 is arranged, or the like. In an embodiment of the pump device 56 as part of an administration device, it is in particular conceivable for the further unit to be in the form of an injection unit, in particular in the form of a needle or syringe unit. The further unit may be directly connected to the conveying space outlet 74, or the further unit may be fluidically connected to the conveying space outlet 74 by means of a separate conveying line, for example a hose. Further fluidic connections of the further unit to the conveying space outlet 74 that appear expedient to a person skilled in the art are likewise conceivable.

FIG. 3 shows a cross-section through the conveying space 12, wherein the conveying element 16 is illustrated in a load-free state. In particular, no conveyance of a conveying medium occurs in a load-free state of the conveying element 16. The conveying element 16 can be arranged at least partly in convexly curved fashion on the conveying space element 14. The conveying element 16 is, at least in a load-free state, in particular in a state in which it is not loaded by the action of a drive force that can be generated by means of the drive unit 58, arranged at least partly in convexly curved fashion on the conveying space element 14. The conveying space element 14 has at least one concave recess 76 for at least partly delimiting and/or for at least partly forming the conveying space 12. An inner surface, which delimits the recess 76, of the conveying space element 14 forms the rigid wall 24 of the conveying space element 14. The conveying element 16 is deformable such that, for a conveyance of a conveying medium, the conveying element 16 is movable in the direction of the recess 76 and is in particular movable at least partly into said recess (FIG. 4). The conveying element 16 is of spring-elastic form. The conveying element 16 is connected at least substantially non-detachably to the conveying space element 14, in particular in an edge region, which delimits the recess 76, of the conveying space element 14. The at least substantially non-detachable connection of the conveying element 16 to the conveying space element 14 forms, in particular, a seal between the conveying element 16 and the conveying space element 14. It is however also conceivable for an additional seal element of the conveying device 10 to be arranged between the conveying element 16 and the conveying space element 14. The conveying space 12 can preferably be sealed off in fluid-tight fashion as a result of a connection to the conveying space element 14 and/or as a result of an arrangement of the conveying element 16 on the conveying space element 14. For a conveyance of a conveying medium in and/or through the conveying space 12, the conveying surface 18 can, as a result of the action of a drive force that can be generated by the drive unit 58, be caused to bear, in particular be caused to bear entirely, against the wall 24 of the conveying space element 14, which wall delimits the conveying space 12, in particular against the inner surface, which delimits the recess 76, of the conveying space element 14 (FIG. 4). A conveyance of a conveying medium in and/or through the conveying space 12 can be achieved as a result of the action of a drive force, which can be generated by the drive unit 58, on the conveying element 16 which is allocated to the conveying space 12, whereby a traveling-wave movement can be generated. The conveying medium can be conveyed out of at least the conveying medium store unit 60, through at least one conducting element (not illustrated in any more detail here) and into and/or through the conveying space 12, in particular owing to a negative pressure, by means of the action of a drive force, which can be generated by the drive unit 58, on the conveying element 16. Furthermore, the conveying medium can be conveyed out of the conveying space 12 through the conveying space outlet 74 to the further unit by means of the action of a drive force, which can be generated by the drive unit 58, on the conveying element 16.

FIG. 5 shows a detail view of a geometric configuration of the conveying element 16 of the conveying device 10 and of the conveying space element 14 of the conveying device 10. The conveying element 16, in particular the conveying surface 18 of the conveying element 16, has, in a load-free state, and viewed in a cross-section of the conveying element 16, at least one circular arc segment 26 which has a maximum length 28 which is made up of a sum of maximum lengths 30, 32, 34 of circular arc segments 36, 38, 40 of the rigid wall 24 of the conveying space element 14. Viewed in the cross-section of the conveying element 16, the conveying surface 18 of the conveying element 16 extends from a fastening region of the conveying element 16, which fastening region bears against the conveying space element 14 at all times when the conveying element 16 is in a state arranged on the conveying space element 14, to a further fastening region of the conveying element 16, which fastening region is arranged at an end of the conveying element 16 which is averted from the fastening region.

Viewed in a cross-section, the rigid wall 24 of the conveying space element 14 furthermore has at least three consecutive circular arc segments 36, 38, 40. The circular arc segments 36, 38, 40 of the rigid wall 24 of the conveying space element 14 are part of the inner surface of the conveying space element 14. The inner surface of the conveying element 16 is arranged on a side, facing toward the conveying element 16, of the conveying space element 14. Viewed in a cross-section, the rigid wall 24 of the conveying space element 14 has at least the three circular arc segments 36, 38, 40, wherein at least two of the three circular arc segments 36, 38, 40 have different radii 42, 44, 46. Two of the three circular arc segments 36, 38, 40 of the rigid wall 24 of the conveying space element 14 have equal radii 42, 46. Said two of the three circular arc segments 36, 38, 40 of the rigid wall 24 of the conveying space element 14 are arranged at the outside. One of the three circular arc segments 36, 38, 40 of the rigid wall 24 of the conveying space element 14 has a radius 44 which differs from the radii 42, 44 of said two of the three circular arc segments 36, 38, 40 of the rigid wall 24 of the conveying space element 14 which are arranged at the outside. That one of the three circular arc segments 36, 38, 40 of the rigid wall 24 of the conveying space element 14 which has a different radius 44 in relation to said two of the three circular arc segments 36, 38, 40 of the rigid wall 24 of the conveying space element 14 is, as viewed at least substantially perpendicular to the conveying direction 66, arranged between said two of the three circular arc segments 36, 38, 40 of the rigid wall 24 of the conveying space element 14 which have the same radii 42, 46. It is however also conceivable for all three circular arc segments 36, 38, 40 of the rigid wall 24 of the conveying space element 14 to have different or equal radii 42, 44, 46. Further embodiments of the radii 42, 44, 46 of the circular arc segments 36, 38, 40 of the rigid wall 24 of the conveying space element 14 that appear expedient to a person skilled in the art are likewise conceivable. The conveying element 16, in particular the conveying surface 18 of the conveying element 16, has, at least in a load-free state of the conveying element 16, at least one circular arc segment 26, which has a radius 52 which is greater than a radius 42, 44, 46 of at least one of the three circular arc segments 36, 38, 40 of the rigid wall 24 of the conveying space element 14.

It is preferable for at least the sum of the maximum lengths 30, 32, 34 of the three circular arc segments 36, 38, 40 of the rigid wall 24 of the conveying space element 14 to be equal to the maximum length 28 of the circular arc segment 26 of the conveying element 16, in particular of the conveying surface 18 of the conveying element 16. In the geometrical design of the conveying element 16 and of the conveying space element 14, the condition preferably applies that a distance between points $A_1$ and $A_2$ along the circular arc segment 26 of the conveying element 16 is, with regard to a length, equal to a distance between points $A_1$, $T_1$, $T_2$, $T_3$, $T_4$ and $A_2$ along the three circular arc segments 36, 38, 40 of the rigid wall 24 of the conveying space element 14. The maximum transverse extent 20 of the conveying surface 18 is particularly preferably equivalent to a length of the distance between the points $A_1$ and $A_2$. The maximum transverse extent of the rigid wall 24 of the conveying space element 14, which wall at least partly delimits at least the conveying space 12, is preferably equivalent to a length of the distance between the points $A_1$, $T_1$, $T_2$, $T_3$, $T_4$ and $A_2$.

Viewed in the cross-section, the rigid wall 24 of the conveying space element 14 furthermore has at least the two directly consecutive circular arc segments 36, 38, 40, which are arranged so as to adjoin one another at an inflection point 48, 50. Those two of the three circular arc segments 36, 38, 40 of the rigid wall 24 of the conveying space element 14 which are arranged at the outside are, in each case at an inflection point 48, 50, arranged so as to directly join that one of the three circular arc segments 36, 38, 40 of the rigid wall 24 of the conveying space element 14 which is arranged between said two of the three circular arc segments 36, 38, 40 of the rigid wall 24 of the conveying space element 14 which are arranged at the outside.

Furthermore, the conveying device 10 comprises a maximum conveying space height 54 between the conveying element 16 and the conveying space element 14, which conveying space height is smaller than a radius 42, 44, 46 of at least one of the three circular arc segments 36, 38, 40 of the rigid wall 24 of the conveying space element 14 and/or is smaller than a radius 52 of at least the circular arc segment 26 of the conveying element 16, in particular of the conveying surface 18 of the conveying element 16.

The invention claimed is:

1. A conveying device at least for conveying a conveying medium, comprising:

at least one conveying space element that is embodied in a rigid fashion, that includes a conveying space inlet and a conveying space outlet, and that at least partly delimits at least one conveying space; and at least one elastically deformable conveying element that delimits the conveying space together with the conveying space element, wherein the conveying space element comprises a rigid wall that forms at least one concave recess for at least partly forming the conveying space, the conveying space element includes an inner surface that delimits the concave recess and that forms a wall of the conveying space, the elastically deformable conveying element comprises at least one conveying surface, which is utilizable in a targeted fashion for a conveyance of a fluid in the conveying space and/or through the conveying space, the conveying surface in a load-free state of the elastically deformable conveying element has a maximum transverse extent that is equivalent to a maximum transverse extent of the rigid wall of the conveying space element with respect to a cross-section of the elastically deformable conveying element, the maximum transverse extent of the elastically deformable conveying element is formed by a length of an outline of the elastically deformable conveying element facing the conveying space element, and the maximum transverse extent of the rigid wall of the conveying space element is formed by a length of an outline of the rigid wall, the maximum transverse extent of the conveying surface of the elastically deformable conveying element runs transversely to a conveying direction in the conveying space and in a plane extending perpendicular to the conveying direction, the conveying direction in the conveying space runs from the conveying space inlet to the conveying space outlet of the conveying space, the cross-section of the elastically deformable conveying element runs in a plane extending perpendicular to the conveying direction, and the elastically deformable conveying element is embodied in a spring-elastic fashion in which the elastically deformable conveying element automatically seeks to re-assume a convexly curved basic shape of the elastically deformable conveying element following a deformation.

2. The conveying device according to claim 1, wherein the elastically deformable conveying element in the load-free state comprises at least one circular arc segment that has a maximum length corresponding to a sum of maximum lengths of circular arc segments of the rigid wall of the conveying space element with respect to a cross-section of the conveying space element that runs in the plane extending perpendicular to the conveying direction.

3. The conveying device according to claim 1, wherein the rigid wall of the conveying space element comprises, viewed in a cross-section of the conveying space element which runs in the plane extending perpendicular to the conveying direction, at least three consecutive circular arc segments.

4. The conveying device according to claim 1, wherein the rigid wall of the conveying space element comprises, viewed in a cross-section of the conveying space element which runs in the plane extending perpendicular to the conveying direction, at least three circular arc segments, wherein at least two of the three circular arc segments have different radii.

5. The conveying device according to claim 1, wherein the rigid wall of the conveying space element comprises, viewed in a cross-section of the conveying space element which runs in the plane extending perpendicular to the conveying direction, at least two directly consecutive circular arc segments, which are arranged in such a way that they abut on each other in an inflection point.

6. The conveying device according to claim 1, wherein, at least in the load-free state, the conveying element comprises at least one circular arc segment having a radius which is greater than a radius of at least one circular arc segment of the rigid wall of the conveying space element.

7. The conveying device according to claim 1, comprising a maximum conveying space height between the conveying element and the conveying space element, which is smaller than a radius of at least one circular arc segment of the rigid wall of the conveying space element and/or than a radius of at least one circular arc segment of the conveying element.

8. The conveying device according to claim 1, wherein the conveying element is arrangeable on the conveying space element in an at least partly convexly curved fashion.

9. A pump device, comprising:

at least one conveying device for conveying a conveying medium that comprises at least one conveying space element that is embodied in a rigid fashion, that includes a conveying space inlet and a conveying space outlet, and that at least partly delimits at least one conveying space, and at least one elastically deformable conveying element that delimits the conveying space together with the conveying space element; and at least one drive unit for driving the conveying device, wherein the conveying space element comprises a rigid wall that forms at least one concave recess for at least partly forming the conveying space, the conveying space element includes an inner surface that delimits the concave recess and that forms a wall of the conveying space, the elastically deformable conveying element comprises at least one conveying surface, which is utilizable in targeted fashion for a conveyance of a fluid in the conveying space and/or through the conveying space, the conveying surface in a load-free state of the elastically deformable conveying element has a maximum transverse extent that is equivalent to a maximum transverse extent of the rigid wall of the conveying space element with respect to a cross-section of the elastically deformable conveying element, the maximum transverse extent of the elastically deformable conveying element is formed by a length of an outline of the elastically deformable conveying element facing the conveying space element, and the maximum transverse extent of the rigid wall of the conveying space element is formed by a length of an outline of the rigid wall, the maximum transverse extent of the conveying surface of the elastically deformable conveying element runs transversely to a conveying direction in the conveying space and in a plane extending perpendicular to the conveying direction, wherein the conveying direction in the conveying space runs from the conveying space inlet to the conveying space outlet of the conveying space, the cross-section of the elastically deformable conveying element runs in a plane extending perpendicular to the conveying direction, the elastically deformable conveying element is embodied in a spring-elastic fashion in which the elastically deformable conveying element automatically seeks to re-assume a convexly curved basic shape of the elastically deformable conveying element following a deformation.

10. A conveying device at least for conveying a conveying medium, comprising:

at least one conveying space element that is embodied in a rigid fashion, that includes a conveying space inlet and a conveying space outlet, and that at least partly delimits at least one conveying space; and at least one elastically deformable conveying element that delimits the conveying space together with the conveying space element, wherein the conveying space element comprises at least one concave recess for at least partly forming the conveying space, the conveying space element includes an inner surface that delimits the concave recess and that forms a wall of the conveying space, the elastically deformable conveying element comprises at least one conveying surface, which is utilizable in targeted fashion for a conveyance of a fluid in the conveying space and/or through the conveying space, the conveying surface in a load-free state of the conveying element has a maximum transverse extent that is equivalent to a maximum transverse extent of the rigid wall of the conveying space element with respect to a cross-section of the elastically deformable conveying element, the maximum transverse extent of the conveying surface of the elastically deformable conveying element runs transversely to a conveying direction in the conveying space and in a plane extending perpendicular to the conveying direction, the conveying direction in the conveying space runs from the conveying space inlet to the conveying space outlet of the conveying space, the cross-section of the elastically deformable conveying element runs in a plane extending perpendicular to the conveying direction, the elastically deformable conveying element is embodied in a spring-elastic fashion in which the elastically deformable conveying element automatically seeks to re-assume a convexly curved basic shape of the elastically deformable conveying element following a deformation, and the rigid wall of the conveying space element comprises at least three consecutive circular arc segments with respect to a cross-section of the conveying space element that runs in the plane extending perpendicular to the conveying direction, two of the three consecutive circular arc segments of the rigid wall of the conveying space element have a convex curvature, and one of the three consecutive circular arc segments of the rigid wall of the conveying space element has a concave curvature.

* * * * *